US009359184B2

(12) United States Patent
Post et al.

(10) Patent No.: US 9,359,184 B2
(45) Date of Patent: Jun. 7, 2016

(54) FLUID DISPENSER AND METHOD FOR DISPENSING FLUIDS

(71) Applicant: Fast & Fluid Management B.V., Sassenheim (NL)

(72) Inventors: Johannes Hermanus Nicolaas Post, Sassenheim (NL); Wouter Dijkstra, Soest (NL); M. E. J. L. Driessen, Oegstgeest (NL)

(73) Assignee: Fast & Fluid Management B.V., Sassenheim (NL)

( * ) Notice: Subject to any disclaimer, the term of this patent is extended or adjusted under 35 U.S.C. 154(b) by 24 days.

(21) Appl. No.: 14/229,261

(22) Filed: Mar. 28, 2014

(65) Prior Publication Data

US 2014/0326748 A1 Nov. 6, 2014

(30) Foreign Application Priority Data

Apr. 4, 2013 (EP) ..... 13162349

(51) Int. Cl.

| | |
|---|---|
| ***B67D 1/00*** | (2006.01) |
| ***B67D 7/14*** | (2010.01) |
| ***B67D 7/32*** | (2010.01) |
| ***B01F 13/10*** | (2006.01) |

(52) U.S. Cl.

CPC ..... *B67D 7/3245* (2013.01); *B01F 13/1058* (2013.01); *B67D 7/3281* (2013.01); *B67D 2007/329* (2013.01)

(58) Field of Classification Search

CPC ..... B67D 7/3245; B67D 7/3281; B67D 2007/329; B01F 13/1058

USPC ..... 222/55

See application file for complete search history.

(56) References Cited

U.S. PATENT DOCUMENTS

| | | | | |
|---|---|---|---|---|
| 5,992,686 | A * | 11/1999 | Cline | B05B 7/32 222/1 |
| 6,003,731 | A | 12/1999 | Post et al. | |
| 6,536,683 | B1 * | 3/2003 | Filicicchia | A23G 1/0066 222/318 |
| 2005/0284882 | A1 * | 12/2005 | Belongia | A67D 7/08 222/64 |

(Continued)

FOREIGN PATENT DOCUMENTS

| | | | |
|---|---|---|---|
| EP | 0443741 | A1 | 8/1991 |
| GB | 767279 | A | 1/1957 |
| WO | 2007011830 | A2 | 1/2007 |

OTHER PUBLICATIONS

Extended European Search Report for corresponding EP Application No. 13162349.8; Report dated Sep. 20, 2013.

*Primary Examiner* — Patrick M Buechner
*Assistant Examiner* — Jeremy W Carroll
(74) *Attorney, Agent, or Firm* — Miller, Matthias & Hull LLP

(57) ABSTRACT

A fluid dispenser comprising a fluid container and a metering unit is disclosed. The container comprises a fluid level sensor and the dispenser comprises a control unit configured to determine a parameter value representative for an amount of fluid in the container after refill on basis of a signal from the sensor. The sensor can for example be configured to generate a signal at a predefined fluid level (B, C), while the control unit is configured to calculate a fluid level on basis of an input value indicative of the fluid level (A) after refill, and a dispense value indicative of amounts of fluid dispensed since the latest refill. The control unit can be configured to compare the signalled predefined fluid level (B, C) with the calculated fluid level to generate a correction factor.

7 Claims, 8 Drawing Sheets

(56) References Cited

U.S. PATENT DOCUMENTS

2006/0032862 A1* 2/2006 Miller ..... B67D 1/0871 222/64
2006/0080041 A1* 4/2006 Anderson ..... B01F 13/1055 702/19
2012/0250451 A1* 10/2012 Post ..... B01F 5/0206 366/137
2014/0138400 A1* 5/2014 Donner ..... B05C 5/0291 222/1
2015/0021358 A1* 1/2015 Shimono ..... F23K 3/02 222/55

* cited by examiner

FLUID DISPENSER AND METHOD FOR DISPENSING FLUIDS

BACKGROUND

A fluid dispenser, such as a paint or colorant dispenser, is disclosed that may include one or more fluid containers and one or more metering units connectable to the fluid container. A method of preparing a fluid, such as paint, by selectively metering one or more fluid components using such a fluid dispenser is also disclosed.

DESCRIPTION OF THE RELATED ART

Paint delivery systems typically make use of a number of different components, such as base paints, pigment pastes or paint modules, to formulate a desired paint composition. Each component is contained in a separate container connected or connectable to a metering unit with a dispense pump. The fluid containers and the pumps may for example be disposed on a turntable or along one or more stationary horizontal rows. Examples of such a paint delivery system are disclosed in U.S. Pat. No. 6,003,731 and WO 2007/011830.

To deliver a paint of the desired color or composition, the selected components should be metered accurately. Inaccurate metering of selected paint components during paint formulation can occur if one of the fluid containers holding one of the selected paint components runs dry before the desired quantity of the dispersion could be dispensed.

To reduce the risk of misformulating a paint, dispensers have been proposed requiring input from an operator indicating the amount of fluid supplied to the fluid container when the operator refills the fluid container. During dispensing, the dispensed amount is accurately monitored. A control unit can calculate the actual fluid content in the fluid container as the refill amount minus the dispensed amount. If the calculated amount passes a lower limit value the control unit may generate a signal warning an operator that refill of the fluid container is required, or the control unit can even be configured to stop dispensing.

In general practice containers of such paint delivery systems are refilled using packages, such as tins or bags, of a standard volume. Due to factors like fluid viscosity and constructional configuration of the outlet opening of the tins or bags, part of the fluid will not flow into the paint container but will be left in the package.

GB 767,279 discloses a dispenser for paints comprising a ball float for directing attention to the fact that the liquid level in a container is low and that refill is required. This system does not provide information about the actual fluid level before the level is low.

Accordingly, there is a need for a more accurate monitoring of the amount of fluid in a fluid container of a fluid dispenser system, enabling improved stock control, in particular for formulating paints, with a reduced risk of misformulating a fluid resulting from unexpected shortage of one or more fluid components.

SUMMARY OF THE DISCLOSURE

A fluid dispenser is disclosed comprising at least one fluid container, at least one metering unit connected or connectable to the fluid container, at least one fluid level sensor and a control unit configured to determine a parameter value representative for an amount of fluid in the fluid container after a refill. The amount of fluid can continuously be sensored, e.g., by a weight sensor, or can be calculated on basis of the fluid amount just after a refill less any amounts dispensed after the refill.

It was found that this results in a substantially more reliable monitoring of the fluid stock in the fluid containers. In prior art systems the actual amount in the paint container was found to be less than indicated by the operator resulting in a deviation of the calculated container content from the actual content. Such deviation accumulates with each refill and increases the risk of misformulating a paint composition caused by a container unexpectedly running dry. Moreover, incorrect refill data may be fed to the control unit by an operator. With the presently disclosed fluid dispenser, the actual fluid level is more accurately determined and a refill alert cannot be ignored.

In a specific embodiment the fluid dispenser comprises at least one fluid container and at least one metering unit connected or connectable to the fluid container. The fluid container comprises at least one level sensor configured to generate a predefined fluid level signal at a predefined fluid level. The fluid dispenser also comprises a control unit configured to calculate a calculated fluid level value based on an input value indicative of the fluid level at a refill point of time, and a dispense value indicative of amounts of fluid dispensed since the refill point of time. In response to the signal of the sensor, the control unit compares the predefined fluid level signal with the calculated fluid level value to generate a correction factor. This enables correction of later refill data. Repeated calibration this way results in more accurate determination of the refill amounts. Stock level data, e.g., in a stock level database can be corrected and updated. The actual fluid content in the fluid container can be monitored accurately and continuously and a required refill can be anticipated timely before the fluid container can run dry in a single dispense cycle.

The sensor may for example generate a stop signal at a minimum fluid level. In response to such signal the control unit stops the dispense cycle. In such case, ignoring refill warning signals, as was found to occur with prior art systems, is not possible anymore. Alternative, or additionally, the dispenser may comprise a level sensor generating a warning signal at a warning fluid level above a minimum level, the dispenser comprising a user interface generating a refill alert in response to the generated signal.

The level sensors can for example be or comprise a pressure sensor, a capacitive sensor, a vibration sensor, an electro-optical sensor, a magneto-elastic sensor, a field effect sensor, an ultrasonic sensor, a weight sensor and/or a floater sensor. Vibration sensors can also be used for use with dispensers for powder coatings. Field effect sensors are particularly suitable. Such field effect sensors generate an electromagnetic field through the dielectric barrier of the container wall. When the fluid level lowers and leaves the field of the sensor, the sensor detects the change and generates an output signal indicating that the fluid has reached a predefined level.

The dispenser can, for example, comprise a plurality of containers, the control unit being configured to selectively dispense a predetermined amount from one or more of the fluid containers into a receptacle. Such a dispenser is particularly suitable for use as a paint delivery system metering and mixing selective components to formulate a paint of a desired quality or color. Such a dispenser may, e.g., comprise a support, such as a turntable, supporting the fluid containers, the support being movable in response to the control unit to move a selected container to a dispense position.

In a further aspect, a method is disclosed for dispensing a fluid from a fluid container. The fluid level is calculated on basis of an input amount entered at a refill of the fluid container minus an amount of fluid dispensed since the refill. A signal is generated by a level sensor when the fluid level reaches a predefined value. A deviation of the calculated fluid level at the moment that the signal is generated, from the predefined level is used. The calculated deviation can be used to update stock data. Additionally, or alternatively, the calculated deviation can be used to generate a correction factor for correcting the entered input amount with a next refill.

Optionally, a warning signal can be generated at a warning fluid level, initiating a refill alert. The fluid container can be refilled with an amount entered into the control unit by an operator. The refilled amount can be corrected by using the correction factor, and the dispensing cycle can be continued. Alternatively, or additionally, a stop signal is generated at a minimum fluid level. In response to the signal the dispensing cycle is stopped. The fluid container can be refilled with an amount entered into the control unit by an operator. The refilled amount and/or the stock data can be corrected by using the correction factor, and a new dispensing cycle can be started.

DETAILED DESCRIPTION OF THE PRESENTLY PREFERRED EMBODIMENTS

Figure 1:
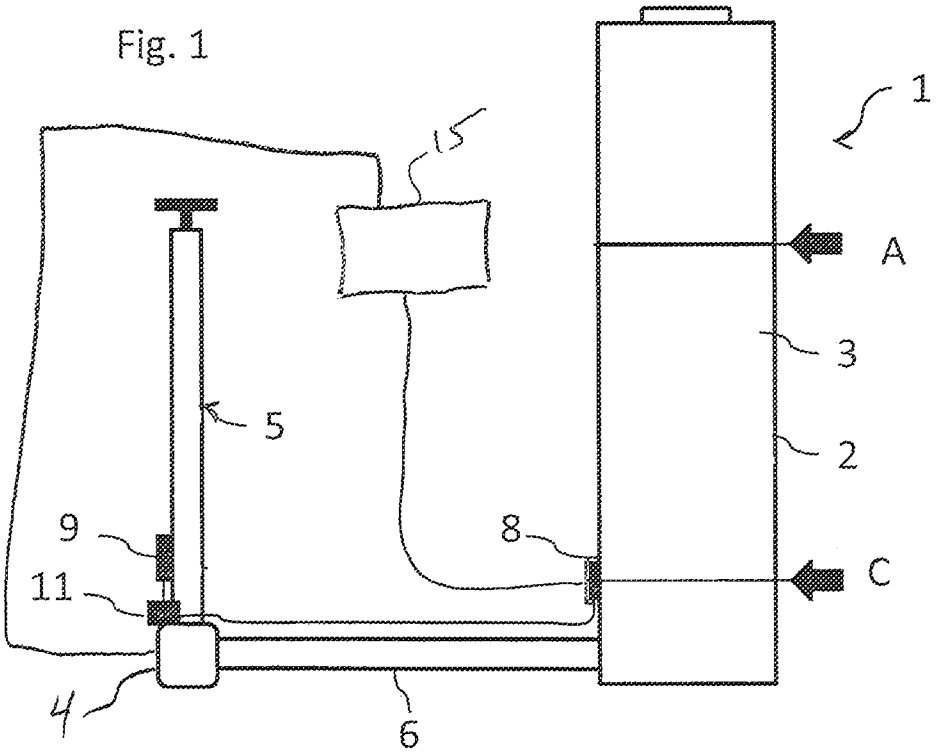
FIG. 1 shows an exemplary embodiment of a coating composition processing apparatus.

FIG. 1 illustrates schematically an exemplary embodiment of a fluid dispenser 1, in particular a paint dispenser, with a fluid container 2 containing an amount of fluid 3, and a metering unit 4 connected to the fluid container. The metering unit 4 comprises a positive displacement pump 5 for moving a metered amount of fluid 3 from the fluid container 2 via a transfer line 6 to the metering unit 4 for dispense into a receptacle (not shown).

A fluid level sensor 8 is attached to the outside of the fluid container 2. The fluid level sensor is a field effect sensor generating an electromagnetic field through the dielectric barrier of the container wall. When the fluid level lowers and leaves the field of the sensor 8, the sensor detects the change and generates an output signal to the control unit 15. The field effect sensor 8 is positioned at a minimum level, indicated in FIG. 1 by arrow C.

After refilling the fluid container 2, e.g., with a standard 1 liter or 5 liter pack of fluid, the operator enters the corresponding standard amount into the control unit 15. The actual refilled amount, corresponding to level A in FIG. 1, may deviate substantially. During subsequent dispensing cycles the control unit 15 monitors dispensed amounts and calculates the amount of fluid 3 left in the fluid container 2 for the purpose of stock control. When the fluid level reaches the level C of the field effect sensor 8 the control unit 15 compares the calculated level with the actual level detected by the field effect sensor 8 and calculates a correction factor to be used to calculate a corrected refill amount after the next refill. This enables a substantially more accurate monitoring of the fluid level 3 in the fluid container 2 over time.

Figure 2:
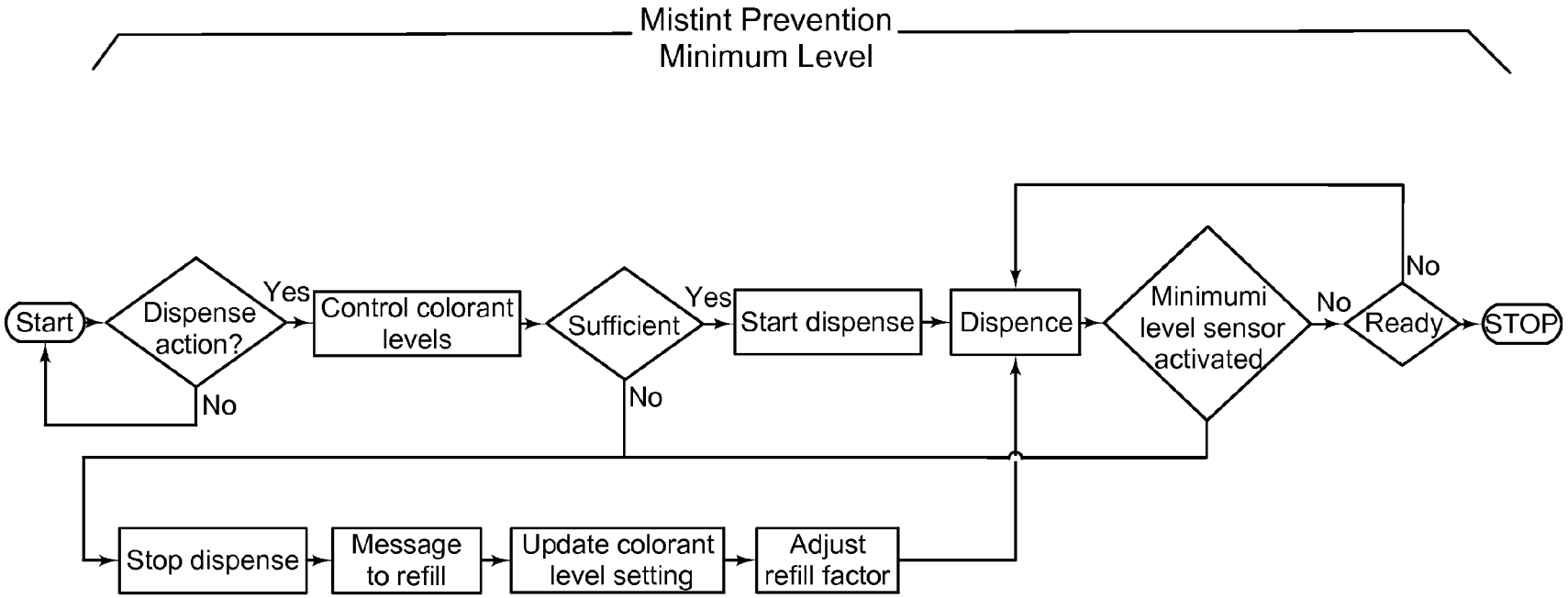
FIG. 2 shows a flow diagram of a process using the dispenser of FIG. 1.

When the field effect sensor 8 detects that the fluid level in the fluid container 2 reaches the minimum level C, it generates a signal triggering an indicator lamp 9, such as an LED, at the pump 5 informing the operator that a refill is required. The signal can also be used to trigger the control unit to alert an operator, e.g., by means of software generated visual information on a display. The indicator lamp 9 and the level sensor 8 are both powered by a power supply 11 at the pump 5. The operator will refill the fluid container 2 and enter the refilled amount of fluid. This data is now corrected using the determined correction factor. This process is represented in the flow diagram of FIG. 2.

Figure 3:
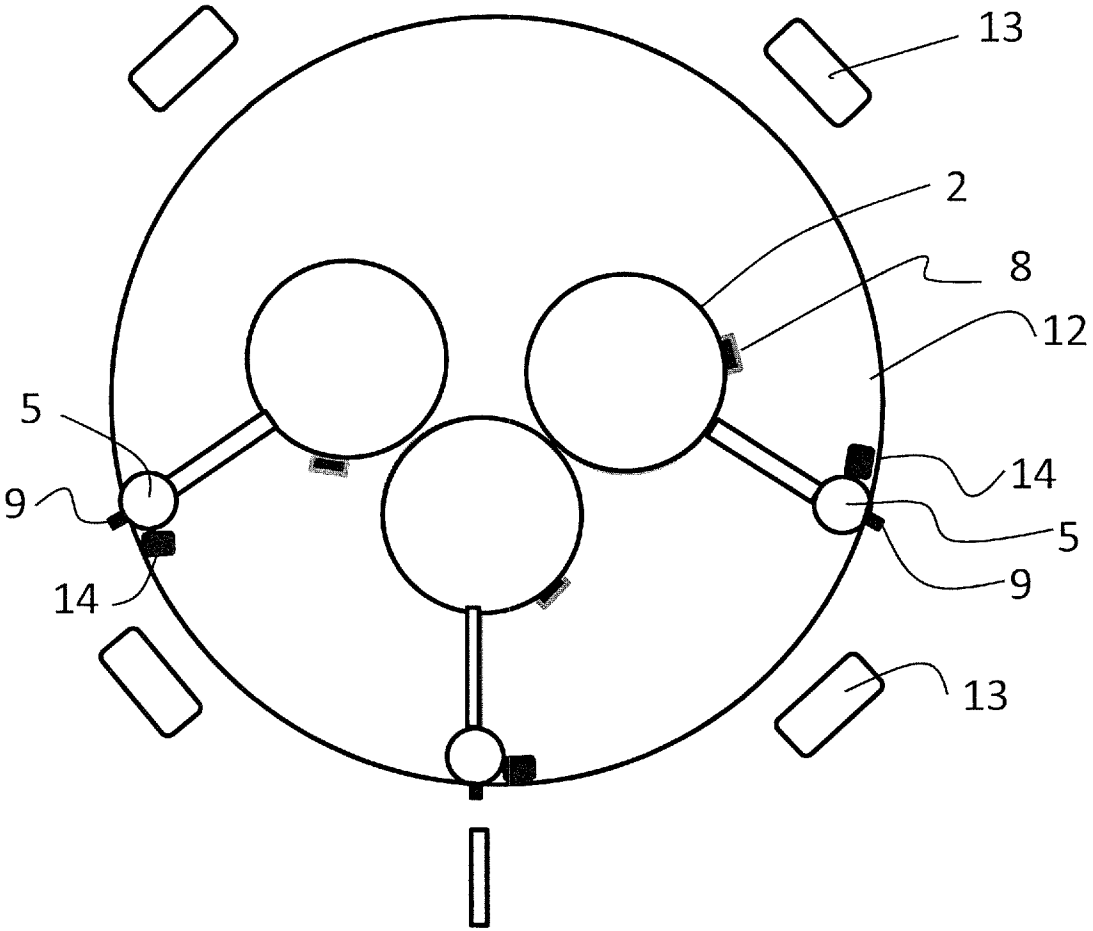
FIG. 3 shows a further exemplary embodiment of a dispenser.

FIG. 3 shows a top view of a turntable 12 supporting a plurality of fluid containers 2 of the type shown in FIG. 1. Each container 2 contains a different component, e.g., a colorant for tinting a paint. Each container 2 has an associated level sensor 8. The turntable 12 can be rotated to position a selected container 2 at a dispense position for dispensing a desired amount of the selected colorant. The turntable 12 is surrounded by a number of magnets 13. Electro-conductive coils 14 are positioned at the pumps 5 at the same level as the magnets 13. When the turntable 12 is turned, the coils 14 power the field effect sensors 8 and the LED indicators 9 by electromagnetic induction when the coils 14 pass the magnetic field of the magnets.

Figure 4:
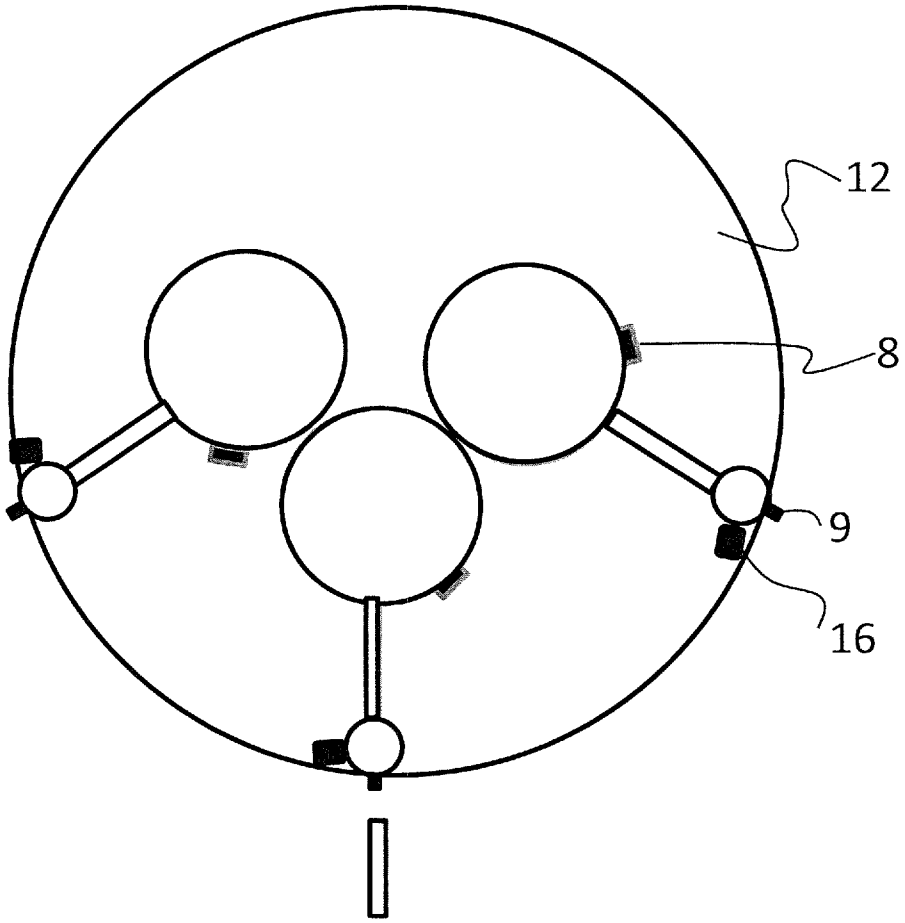
FIG. 4 shows a further exemplary embodiment of a dispenser.
Figure 5:
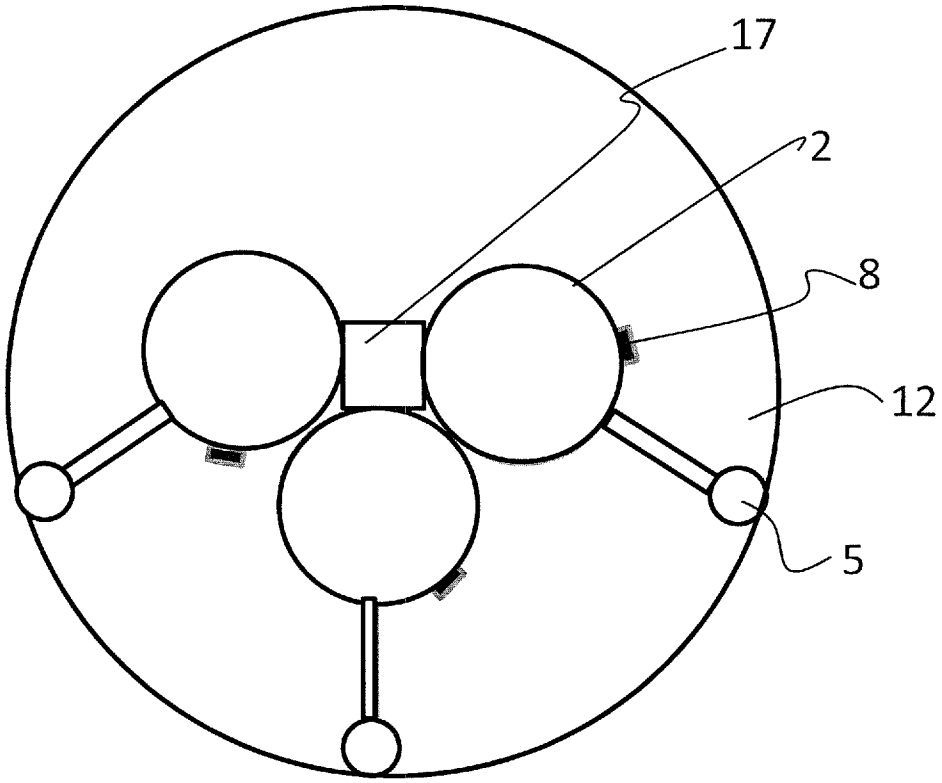
FIG. 5 shows a further exemplary embodiment of a dispenser.

Alternatively, the level sensors 8 and indicators 9 can be powered by a battery 16, as shown in FIG. 4 or by a central power supply and control unit 17 as shown in FIG. 5.

Figure 6:
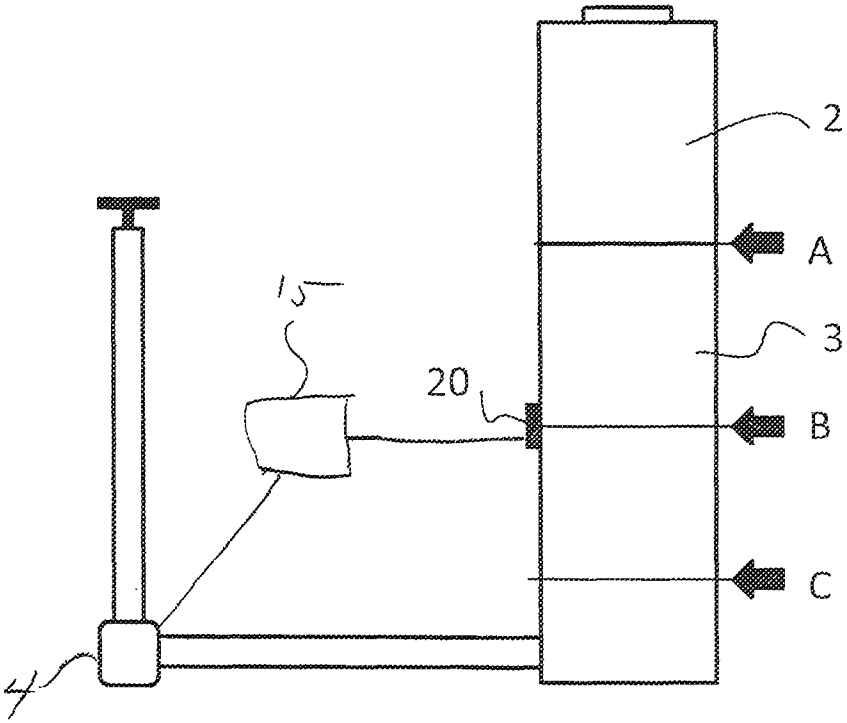
FIG. 6 shows a further exemplary embodiment of a dispenser.
Figure 7:
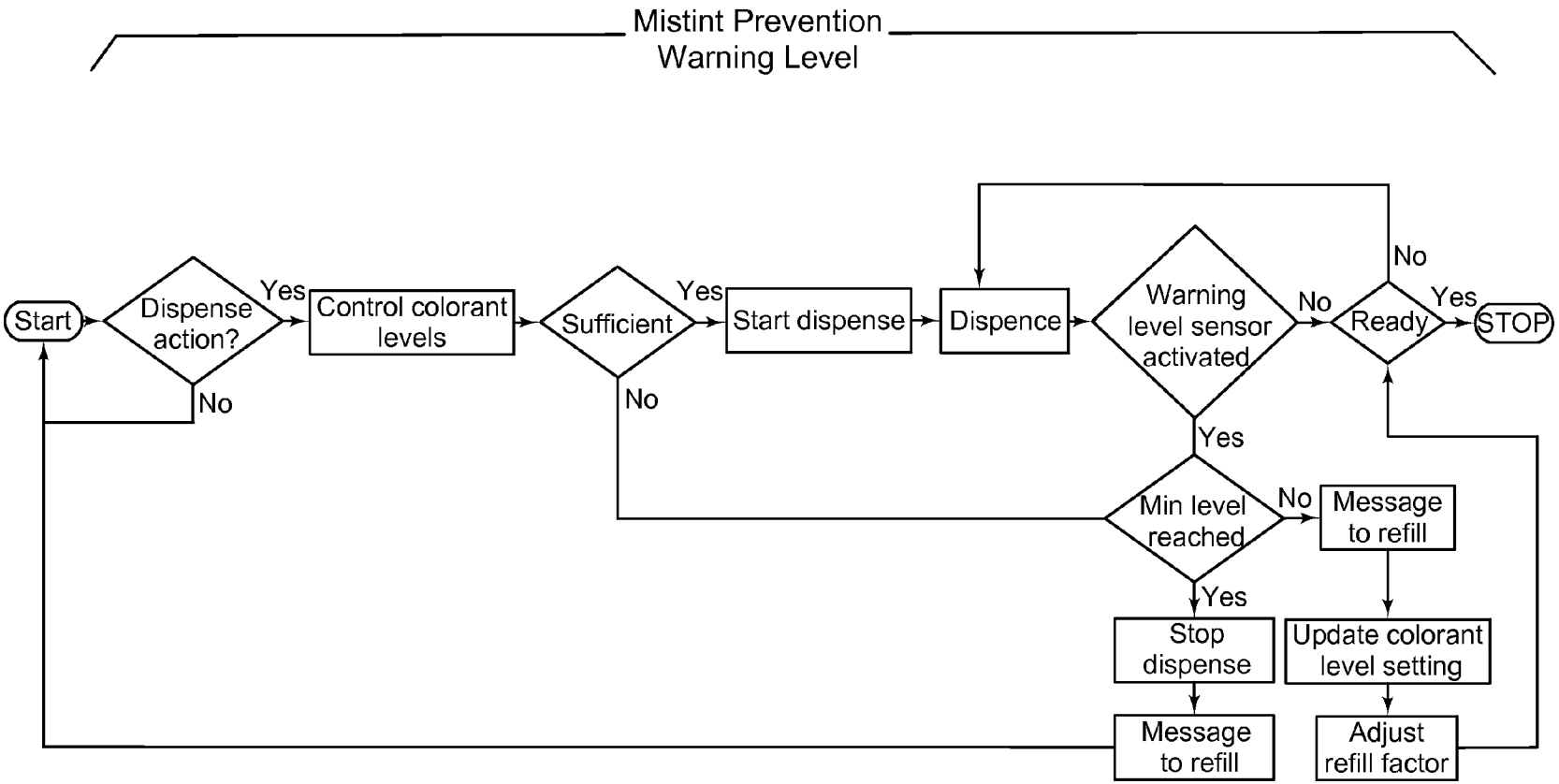
FIG. 7 shows a flow diagram of a process using the dispenser of FIG. 6.

FIG. 6 shows an alternative embodiment of a dispenser 1 similar to the embodiment of FIG. 1, with the difference that it comprises a field effect sensor 20 at a warning level B instead of minimum level C. This makes it possible to use a protocol represented in the flow diagram of FIG. 7. If the fluid level gets below level B, the control unit 15 calculates a correction factor and the operator is requested to refill the fluid container 2 and to enter updated the fluid level data into the control unit 15. The control unit 15 corrects the refill data with the calculated correction factor. The dispenser 1 is now ready to continue the dispensing cycle.

Figure 8:
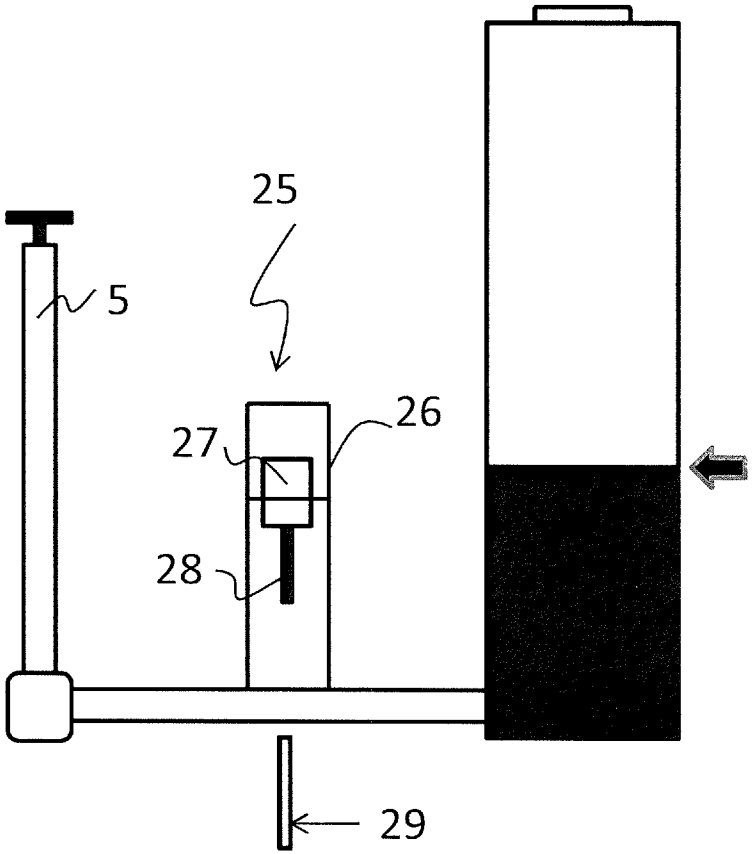
FIG. 8 shows a further exemplary embodiment of a dispenser.

FIG. 8 shows an embodiment of a dispenser 1, again similar to the embodiment of FIG. 1, but with a floater sensor 25. The line 6 between the fluid container 2 and the pump 5 is provided with a column 26 in fluid communication with the fluid container 2 such that the fluid level in the column 26 corresponds to the fluid level in the fluid container 2. The column 26 encases a floater 27 with a downwardly extending metal rod 28. A field effect sensor 29 is positioned below the column 26. If the fluid level is sufficiently low, the metal rod 28 enters the field of the field effect sensor 29 and the sensor 29 generates an output signal indicating that the predefined warning level or minimum level has been reached.

The invention claimed is:

1. A fluid dispenser comprising:

at least one fluid container, at least one metering unit connected or connectable to the fluid container, at least one fluid level sensor and a control unit linked to the fluid level sensor and the metering unit, the fluid level sensor is configured to generate a predefined fluid level signal when a predefined fluid level in the container is reached, the control unit is configured to receive an input amount at a refill point in time based on one or more standard amounts and the predefined fluid level if the fluid level sensor has generated a first predefined fluid level signal, the control unit is further configured to generate a calculated fluid level based on the input amount and a dispensed amount generated by the metering unit indicative of an amount of fluid dispensed since the refill point in time, the control unit is further configured to compare the calculated fluid level value at the time a second predefined fluid level signal is received and to generate a correction factor based on a difference between the calculated fluid level and the predefined fluid level at the time the second predefined fluid level signal is received, the control unit is configured to correct a subsequent input amount using the correction factor.

2. A dispenser according to claim 1, wherein the control unit is configured to repetitively correct subsequent input amounts to correct stock level data.

3. A dispenser according to claim 1, wherein the at least one fluid level sensor generates a warning signal at the predefined fluid level, the dispenser comprising a user interface generating a refill alert in response to the warning signal.

4. A dispenser according to claim 1, wherein the at least one fluid level sensor generates a stop signal at the predefined fluid level, wherein the control unit is configured to stop dispensing in response to the stop signal.

5. A dispenser according claim 1 wherein the at least one fluid level sensor is selected from the group consisting of a field effect sensor, a pressure sensor, a capacitive sensor, a vibration sensor, an electro-optical sensor, an ultrasonic sensor, a weight sensor and/or a floater sensor.

6. A dispenser according to claim 1 comprising a plurality of fluid containers, the control unit being configured to selectively dispense a predetermined amount from one or more of the fluid containers into a receptacle.

7. A dispenser according to claim 6 comprising a support that is movable in response to the control unit to move a selected fluid container to a dispense position.

* * * * *